US006186910B1

(12) United States Patent
Kobayashi

(10) Patent No.: US 6,186,910 B1
(45) Date of Patent: Feb. 13, 2001

(54) SWING TRAINING MACHINE

(75) Inventor: Kando Kobayashi, Machida (JP)

(73) Assignee: J.P. Sports Institute Inc., Tokyo (JP)

( * ) Notice: Under 35 U.S.C. 154(b), the term of this patent shall be extended for 0 days.

(21) Appl. No.: 09/346,729

(22) Filed: Jul. 2, 1999

(30) Foreign Application Priority Data

Jul. 8, 1998 (JP) ..... 10-193299

(51) Int. Cl.[7] ..... A63B 69/00

(52) U.S. Cl. ..... 473/422; 473/269; 473/219; 473/230; 482/147

(58) Field of Search ..... 473/229, 260, 473/453, 112, 118, 223, 216, 277, 252, 215, 259; 482/148, 32, 8, 122, 902, 135, 146, 147; 434/252; 273/449; 472/135

(56) References Cited

U.S. PATENT DOCUMENTS 3,593,994 * 7/1971 Anbar ..... 482/147
3,604,712 * 9/1971 Prior ..... 473/229
4,135,714 * 1/1979 Hughes ..... 473/229
4,560,165 * 12/1985 Witteman et al. ..... 473/269
4,953,858 * 9/1990 Zelli ..... 482/147
5,318,488 * 7/1994 Babcock ..... 482/51
5,433,690 * 7/1995 Gilman ..... 482/146
5,599,240 * 2/1997 Feldmeier ..... 473/218

* cited by examiner

*Primary Examiner*—Jeanette Chapman
*Assistant Examiner*—Mitra Aryanpour
(74) *Attorney, Agent, or Firm*—Browdy And Neimark

(57) ABSTRACT

The invention provides a swing training machine comprising a circular stand of a rotary motion type, a motion arm of an outer circumference rotary type which rotates inversely to the said circular stand, a wire-length setting apparatus mounted on a part of the said arm of an outer circumference rotary type, wire and a handle part. The swing training machine is used for practicing swing motion of golf, throw events, racket sports etc. easily and safely and to strengthening and increasing the flexibility of muscles of arms, shoulders, the body and legs involved in the actual motion of each event.

8 Claims, 1 Drawing Sheet

SWING TRAINING MACHINE

FIELD OF THE INVENTION

This invention relates to a swing training machine for golf, throw events, racket sports etc. for learning a smooth swing motion involving twisting of the body and at the same time, strengthening and improving flexibility of arm muscles, shoulders, the body and legs (abbreviated as the swing training machine hereinafter).

DESCRIPTION OF THE PRIOR ART

Heretofore, there have been twisting machines available at a general sports club etc. as an exercising machine for twisting of the body. To use this machine, one twists his/her body by retaining the posture of the upper half of the body by holding such as a handrail and rotating the lower half of the body on a free rotary stand. The purpose of this machine is, however, to relax or improve flexibility of one's body, and not to learn the motion of sports with twisting motion or to strengthen muscles.

It is possible to strengthen muscles of the body by combining several weight training machines, but that is inefficient to strengthen the muscles mainly concerned which directly contribute to the swing motion. Although it is desirable to do the muscle training exercises with the actual motion in mind, it is difficult for beginners or those who have not yet learned the technique to associate the effect of general muscle training with swing motion characteristic of the actual event, which an expert who has learned the correct motion of the event might be able to do.

In the case of throw training such as golf swing and hammer throw, and training of racket sports such as tennis, it is difficult and inefficient to strengthen muscles required to add power to the swing, and at the same time to have technical training. It is even highly possible to twist one's waist.

SUMMARY OF THE INVENTION

The main objects of the invention are (1) to help the users learn the swing motion, which is difficult to learn by conventional techniques, in golf, throw events, racket sports etc. easily and safely, and at the same time (2) to strengthen and improve flexibility of arm muscles of arms, shoulders, the body and legs effective and efficiently when the actual motion of each event is produced efficiently.

In order to solve the said problems, as a result of his earnest research, the inventor has found that the combination of a self-rotating circular stand of a rotary motion type (abbreviated as the circular stand, hereinafter) and a motion arm of an outer circumference rotary type which rotates inversely to the said circular stand (abbreviated as the arm part, hereinafter) permits safe and easy swing motion involving twist motion of the body; and the proper combination of the said arm part, wire, an apparatus for adjusting the wire length, a handle part and an apparatus for perpendicular motion of the wire-mounted part, or the proper combination of each circular stand-apparatus, a power part and a load apparatus (preferably, a magnetic brake) permits muscle training and motion learning based on the actual motion in various sport events requiring swing motion (golf, hammer throw, tennis etc.).

Figure 1:
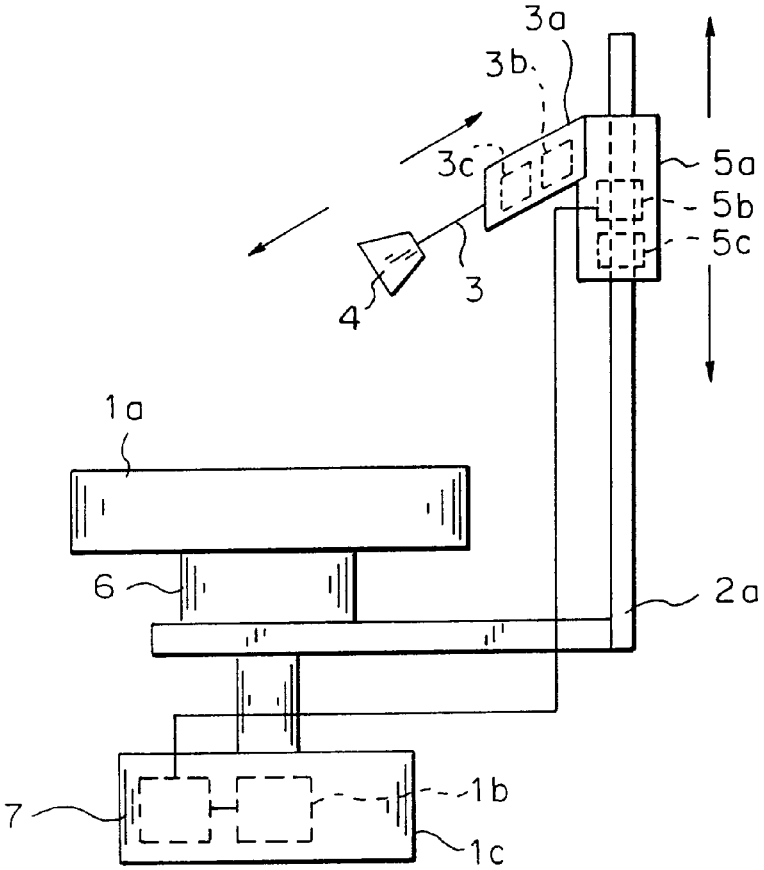
FIG. 1 is a schematic front view of the apparatus of the invention.
Figure 2:
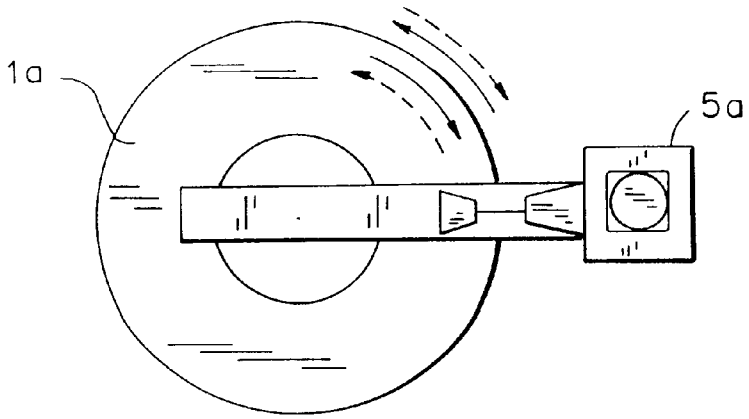
FIG. 2 is a schematic plane view of the apparatus.

In these figures, symbols are shown as follows.

(1*a*): Circular stand of a rotary motion type (1*b*): Power part for the circular stand (1*a*) of the rotary motion type and the motion arm (2*a*) of an outer circumference rotary type (1*c*): Load apparatus for the circular stand (1*a*) of the rotary motion type and the motion arm (2*a*) of the outer circumference rotary type (2*a*): Motion arm of the outer circumference rotary type (3): Wire (3*a*): Wire-length setting apparatus (3*b*): Power part for the wire-length setting apparatus (3*a*)

(3*c*): Load apparatus for the wire-length setting apparatus (3*a*)

(4): Handle part (5*a*): Apparatus for perpendicular motion of the wire-mounted part (5*b*): Power part for the apparatus for perpendicular motion of the wire-mounted part (5*a*)

(5*c*): Load apparatus for the apparatus for perpendicular motion of the wire-mounted part (5*a*)

(6): Cam mechanism

DETAILED DESCRIPTION OF THE INVENTION

The invention provides a swing training machine having the mechanism as shown in the following:

It comprises a circular stand and an arm part which preferably rotates inversely and simultaneously by a cam mechanism, and a wire-length setting apparatus, comprising a wire, a handle part and an apparatus for perpendicular movement of the wire-mounted part installed with the said arm part.

As a power apparatus, a power part of the circular stand-arm part motion apparatus, a power part of the wire-length setting apparatus (abbreviated as the wire power part, hereinafter) and a power part of the apparatus for perpendicular motion of the wire-mounted part can be used. In case a power apparatus is mounted, it is installed at least at a place on the machine. Instead of these or in addition to these, a magnetic brake can be used as a load apparatus.

Referring more particularly to the drawings, a trainee stands on the circular stand (1*a*) and holds the handle part (4) situated at the end of a first wire (3) having a second end engaged to wire length setting apparatus or adjustment means (3*a*). As noted above, the third power part or power apparatus (3*b*) serves to set a length of wiere (3). When he swings the handle part (4) as a hammer thrower rotates a hammer, the arm part (2*a*) rotates and at the same time the circular stand (1*a*) rotates inversely, because the stand has been set to do so by cam mechanism (6). This enables the trainee to practice a motion of waist-centered twisting of the body easily and safely. More concretely, simultaneous inverse rotation enables one to twist quite naturally, and a half round (180 degrees rotation) of the circular stand (i.e. the body) to the ground enables one to obtain one round (360 degrees rotation) in a general way, so that a beginner can easily learn technique, especially throw events such as hammer throw. Besides, by adding rotary velocity from the first power part or power apparatus (1*b*) for driving the circular stand and the arm part, a trainee can learn motion technique at the ideal rotary velocity. Further, by using the load apparatus (preferably magnetic brakes, (3*c*)) mounted on the wire-length setting apparatus (3*a*), centrifugal force can be virtually experienced by controlling the tension, which can be directly associated with the training of the nervous system and muscles used during the motion. In addition, by using the load apparatus (preferably magnetic brakes, (1*c*)) of the circular stand and the arm part, load can be set properly, which can be applied to training of muscles and nervous system used in twisting motion of the body.

The proper arrangement of the apparatus for perpendicular motion of the wire-mounted part or moving apparatus (5*a*) synchronizing with rotation of the circular stand (1*a*) and the arm part (2*a*) or by the computer control (7) by using the second power part for the apparatus for perpendicular motion of the wire-mounted part (5*a*) enables one to have a virtual experience of golf swing. This allows a trainee to practice the technique safely and easily and to train muscles and nervous system used during actual motion by loading properly by using each load apparatus or first magnetic break (1*c*), second magnetic break (3*c*), and third magnetic break (5*c*) mounted on each apparatus (1*a*), (3*a*), (5*a*) as described above. By sloping the circular stand (1*a*), technical practice adapted to actual topography of golf courses is also possible.

Among various combinations of circular stands (1*a*)/arm part (2*a*) of various radii, rotary velocity, rotary angle, wire-length, and magnitude of a load of each load apparatus (1*c*), (3*c*), (5*c*), there sure is one that fits each individual and each sports event.

The invention made it possible to practice ideal swing motion of golf, throw events, racket sports etc. easily safely and repeatedly and to strengthen muscles of arms, shoulders, the body and the legs involved in the actual motion of each event efficiently, which was quite difficult with the art up to this time. Especially simultaneous inverse motions of the upper and the lower half of the body generates the body (particularly thoracic spine and lumbar vertebrae)-centered systematic maximum twist effect, and stretching effect of the body muscles especially increases in the early and late stages of the swing, which contributes to the increase in the body flexibility and increasing the motion range. By setting rotary velocity and rotary load of the rotary motion type circle and wire tensility, anyone from beginners to experts can train on their own level.

I claim:

1. A swing training machine comprising:

a rotatable circular stand (1*a*);

a motion arm (2*a*) rotatable around a circumference of the circular stand (1*a*);

a wire (3) engaged at a first end to a handle (4);

adjustment means (3*a*) engaged to a second end of the wire (3) and the motion arm (2*a*) for setting a length of the wire (3) between the handle (4) and the motion arm (2*a*); and moving apparatus (5*a*) engaged to the adjustment means (3*a*) and the motion arm (2*a*) for moving the adjustment means along a longitudinal axis of the motion arm (2*a*).

2. The swing training machine according to claim 1, further comprising:

a cam mechanism (6) engaged to the circular stand (1*a*) and the motion arm (2*a*) to rotate the motion arm (2*a*) in a direction opposite to a rotation of the circular stand when the handle is moved to rotate the motion arm.

3. The swing training machine according to claim 1, wherein the adjustment (3*a*) has first power apparatus (3*b*) for setting the length of the wire (3).

4. The swing training machine according to claim 3, wherein the moving apparatus (5*a*) has second power apparatus (5*b*) for moving the adjustment means (5*a*) along the longitudinal axis of the motion arm.

5. The swing training machine according to claim 1, wherein the adjustment means (3*a*) further comprises a first magnetic brake (3*c*) for use as load apparatus.

6. The swing training machine according to claim 5, wherein the moving apparatus (5*a*) further comprises a second magnetic brake (5*c*) for use as load apparatus.

7. The swing training machine according to claim 4, wherein the circular stand (1*a*) and the motion arm (2*a*) are coaxially rotated by a third power apparatus (1*b*).

8. The swing training machine according to claim 7, wherein the second power apparatus is synchronized with rotation of the circular stand and the motion arm by a computer (7).

* * * * *